United States Patent [19]

Sherrow et al.

[11] Patent Number: 5,022,810

[45] Date of Patent: Jun. 11, 1991

[54] GURNEY

[75] Inventors: Lionel Sherrow, Huntington Valley; Harold Rosenthal, Philadelphia; Joseph M. Spitz, Bensalem; Stephen W. Haines, Langhorne, all of Pa.

[73] Assignee: Lavelle Aircraft Company, Inc., Philadelphia, Pa.

[21] Appl. No.: 402,381

[22] Filed: Sep. 1, 1989

[51] Int. Cl.[5] ..... A61G 7/08

[52] U.S. Cl. ..... 414/501; 5/81 R; 5/81 B; 280/766.1; 414/590; 414/495; 414/498; 414/541; 414/546; 414/522; 414/680; 414/749; 212/189

[58] Field of Search ..... 414/546, 495, 498, 589, 414/590, 346, 680, 921, 787, 749, 501, 522, 541; 5/81 R, 81 B, 63, 507, 509; 212/189; 296/20; 280/47.11, 763.1, 764.1, 765.1, 766.1; 27/28

[56] References Cited

U.S. PATENT DOCUMENTS

| | | | |
|---|---|---|---|
| 2,542,963 | 2/1951 | Knox et al. | 5/81 B X |
| 3,403,411 | 10/1968 | Steinemann et al. | 5/81 R |
| 3,409,158 | 11/1968 | Lull | 414/590 X |
| 3,452,371 | 7/1969 | Hirsch | 5/81 B X |
| 3,493,979 | 2/1970 | Kroll et al. . | |
| 3,579,672 | 5/1971 | Kroll et al. . | |
| 3,765,037 | 10/1973 | Dunkin . | |
| 3,981,514 | 9/1976 | Visser | 280/765.1 |
| 4,300,782 | 11/1981 | Pioth . | |
| 4,631,761 | 12/1986 | Lederman . | |
| 4,700,417 | 10/1987 | McGovern . | |
| 4,747,170 | 5/1988 | Knouse . | |
| 4,761,841 | 8/1988 | Larsen . | |
| 4,794,655 | 1/1989 | Ooka et al. . | |
| 4,817,977 | 4/1989 | Bookbinder | 280/766.1 X |
| 4,839,933 | 6/1989 | Plewright et al. | 5/81 R |

FOREIGN PATENT DOCUMENTS

| | | | |
|---|---|---|---|
| 542557 | 11/1955 | Belgium | 5/81 R |
| 2809526 | 9/1979 | Fed. Rep. of Germany | 5/81 R |
| 717917 | 11/1954 | United Kingdom | 280/766.1 |

OTHER PUBLICATIONS

MLA Mobilizer Brochure.

*Primary Examiner*—Frank E. Werner

*Attorney, Agent, or Firm*—Caesar, Rivise, Bernstein, Cohen & Pokotilow, Ltd.

[57] ABSTRACT

A transfer device is provided for moving an object from a first location to a second location, in particular a gurney for transporting a hospital patient. The device includes a litter mechanism for carrying the object to be transported thereon and a support structure for supporting the litter mechanism and for transporting the litter mechanism between the first location and the second location. In one embodiment, the litter mechanism is pivotable with respect to the support structure to aid in transferring the object/patient thereto and therefrom. In a second embodiment, the litter mechanism is also moveable laterally and transversely with respect to the support structure. Underneath the support structure are outriggers which are extendable outwardly from the device to stabilize the device and prevent it from tipping over when the litter mechanism is extended transversely with respect to the support structure.

24 Claims, 7 Drawing Sheets

140
158
206
210
600
102
110
118
114
246
242
236
602
128
216
160
4
4
218
238
6
6
162
244
240
126
120
112
116
208
212
10
154
200
101

GURNEY

FIELD OF THE INVENTION

The present invention relates to a device for transporting and transferring non-ambulatory patients from a first location to a second location, such as between a hospital bed and an operating table or an X-ray table. In particular, the present invention relates to a gurney which has a mechanism for transferring patients or other objects thereonto and therefrom.

BACKGROUND OF THE INVENTION

The transfer of non-ambulatory patients between locations in hospitals often presents a formidable task, especially when the patient is large or heavy and there are only limited personnel available. It is usually necessary for several persons to lift and transfer the patient to and from the gurney. Difficulties in transferring patients to and from gurneys often result in injuries to the nurses or attendants who attempt to lift or maneuver the too heavy patients.

These problems are not new, and various devices have been developed and patented in an effort to simplify transferring patient to and from the gurneys. Examples of these various earlier devices include those disclosed in the following patents: U.S. Pat. No. 3,493,979 to Koll et al.; U.S. Pat. No. 3,579,672 to Koll et al.; U.S. Pat. No. 3,765,037 to Dunkin; U.S. Pat. No. 4,631,761 to Lederman; U.S. Pat. No. 4,700,417 to McGovern; U.S. Pat. No. 4,747,170 to Knouse; U.S. Pat. No. 4,761,841 to Larsen; and U.S. Pat. No. 4,794,655 to Ooka et al.

The first Koll patent, (U.S. Pat. No. 3,493,979) teaches a transfer device which includes a pair of superposed endless belts. The lower belt rotates in a predetermined direction, and upper belt rotates in an opposite direction. The transfer device is moved toward the patient and the leading edge of the upper belt is positioned slightly forward of the lower belt. When the device contacts the patient, the leading edge of the upper belt which is rotating in an upwardly-oriented direction lifts the patient up onto the upper belt.

The second Koll Patent (U.S. Pat. No. 3,579,672) is a similar device which includes a pair of superposed aprons formed as endless belts or portions thereof and which function to receive, carry or deposit objects such as patients in accordance with the desired transferring and carrying requirements.

The device disclosed in the Dunkin patent (U.S. Pat. No. 3,765,037) is another belt drive type of transfer device wherein the patient is transferred by means of rotating belts.

The Lederman patent (U.S. Pat. No. 4,631,761) is another gurney for transferring patients which utilizes an endless belt drive system of rollers for transferring the patient onto the gurney. A particular wheel arrangement is provided so that the trolley or support frame moves toward the patient at the same speed the transfer belt is moving so that the patient is gently moved onto the trolley bed.

A different type of transfer system is provided in the gurney disclosed in the McGovern patent (U.S. Pat. No. 4,700,417). In that patent, the means for transferring the patient from the stationary position to the movable gurney is accomplished by using a flexible and foldable transfer sheet attached to the gurney.

The Larsen patent (U.S. Pat. No. 4,761,841) provides a gurney which has a laterally shiftable patient conveyor mounted on a moveable frame. A laterally extendable plate coupled with the gurney frame is provided below the conveyor. The plate extends laterally to rest on the bed surface and the conveyor shifts laterally onto the slate for supportive engagement therewith. The patient is transferred onto the freely moving belting material on the conveyor to remove him from the bed.

In the Knouse patent (U.S. Pat. No. 4,747,170) another gurney construction utilizing an unrollable web is disclosed. There a slotted tube attached to the web grabs the sheet underneath the patient and by rewinding the web pulls the sheet and patient onto the gurney.

The Ooka et al. patent (U.S. Pat. No. 4,794,655) presents yet another truck-mounted patient-moving device which utilizes lateral belt motion to transfer the patient from the stationary support onto the mobile gurney. In this instance, an insertion plate is provided for inserting underneath the patient while the patient is still on the stationary support, e.g. a bed.

As these prior patents clearly disclose, various attempts have been provided for movement of the non-ambulatory patient from a stationary support onto a moveable structure or gurney. Many of the devices provide a means for adjusting the height of the gurney surface and some provide for lateral movement of the patient by sliding a retractable member underneath the patient. None of the inventions, however, have gained any significant popularity. Many do not provide a comfortable litter mattress or provide a simplified approach for transfer, and many of these devices comprise extensive working mechanisms in order to create the lateral surface movement which transfers the patient. Also available are separate transfer devices which are separate and apart from the transfer gurney. These hoist units must be moved into place beside the bed; and several attendants are necessary to lift the patient onto the device. To use such a device simply takes too long, and therefore, it goes unused. It would be very beneficial if a self-contained device were available with fewer working parts, which is still capable of allowing transfer of the non-ambulatory patient by a minimum number of people safely and efficiently.

A further consideration which is not sufficiently addressed by these patents is the need to stabilize the gurney during the transfer of the patient since in almost all instances the surface onto which the patient is transferred is cantilevered or extended away from the mobile support to which it is affixed.

OBJECTS OF THE INVENTION

It is an object of the present invention to provide a transfer device, such as a gurney, for transporting non-ambulatory patients from one location to another which requires only a minimum number of attendants and minimal physical effort to transfer the patient onto or off of the device.

It is an object of the invention to provide a litter which can pivot toward the patient to facilitate positioning the patient onto the litter and removing the patient from the litter.

It is also an object of this invention to provide a device, such as a gurney, having a frame mounted on four casters and which has a litter affixed thereto, the litter being able to move laterally on the frame toward and away from the patient to be moved.

It is a further object of this invention to provide a litter which has an angled edge at its pivoted side to facilitate positioning the patient onto and removing the patient from the litter.

It is yet another object of the invention to provide a device having a frame mounted on casters with a laterally moveable litter pivotably mounted thereon which can be stabilized during the lateral movement of the litter.

In particular, it is an object to provide a device which is stabilized during lateral movement of the litter by providing outriggers which are extendable therefrom.

It is an object of the invention to provide a device which is stabilized during lateral movement of a litter mounted thereon and which prevents lateral movement of the litter unless the device is stabilized.

It is an object of the invention to provide a device for transferring non-ambulatory patients which can be positioned close to the surface from or to which the non-ambulatory patient is transferred.

Is still another object of the invention to provide a device for transferring non-ambulatory patients which provides handrails for preventing the patient from falling off the device, the handrails being moveable to allow transfer of the patient onto and off of the device.

It is an object of the invention to provide a device for transferring and transporting non-ambulatory patients from one surface to another which is adjustable to the height of each surface.

SUMMARY OF THE INVENTION

These and other objects of the transfer device of the present invention are achieved by providing a transfer device, such as a hospital gurney, for moving an object, e.g., a patient, from a first location to a second location. The device includes a litter mechanism for carrying the object to be transported thereon and a support structure for supporting the litter mechanism and transporting the litter mechanism between the first location and the second location. In a first embodiment, the litter mechanism is pivotable adjacent its leading edge to aid in transferring the object/patient thereto and therefrom. In a second embodiment, the litter mechanism is also moveable laterally and transversely with respect to the support structure to further aid in transferring the object/patient thereto and therefrom. Underneath the support structure are outriggers which are extendable outwardly from the device to stabilize the device and prevent it from tipping over when the litter mechanism is extended transversely with respect to the support structure.

BRIEF DESCRIPTION OF THE DRAWINGS

Other objects and many of the attendant advantages of the instant invention will become more readily appreciated when the same become better understood by reference to the following detailed description considered in conjunction with the accompanying formal drawings, wherein.

DETAILED DESCRIPTION OF THE PREFERRED EMBODIMENT

Figure 1:
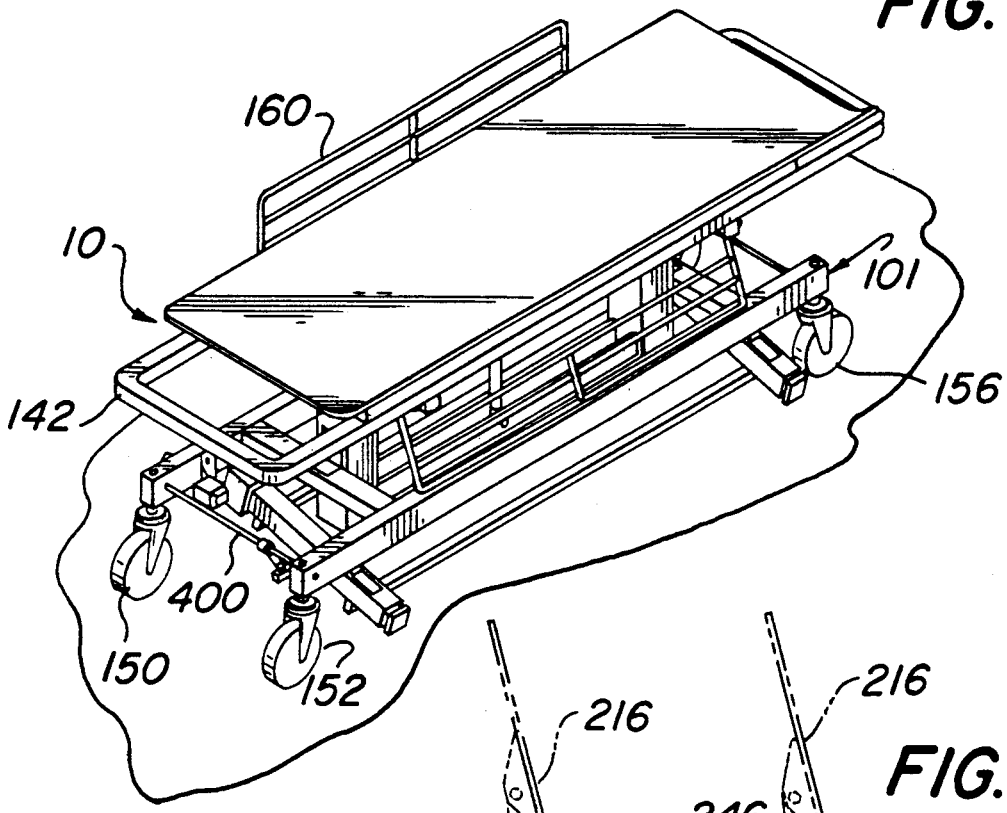
FIG. 1 is an isometric view of the transfer device or gurney of the present invention.

Referring in detail to the various figures of the drawings wherein like reference characters refer to like parts, the transfer device of the present invention is shown at 10 in FIG. 1. The transfer device 10 includes in working combination a support frame 100, a litter mechanism 200 mounted atop the support frame 100 which is capable of pivoting and moving laterally in a direction transverse to the support frame 100 and a stabilizing mechanism 300 mounted underneath the support frame 100 which stabilizes the support frame 100 and the litter mechanism 200 when the litter 200 is moved laterally with respect to the support frame. Provided at the bottom of the support frame 100 are wheels or casters interconnected by a central braking system 400 for controlling swivel and rotational movement of the wheels.

Figure 2:
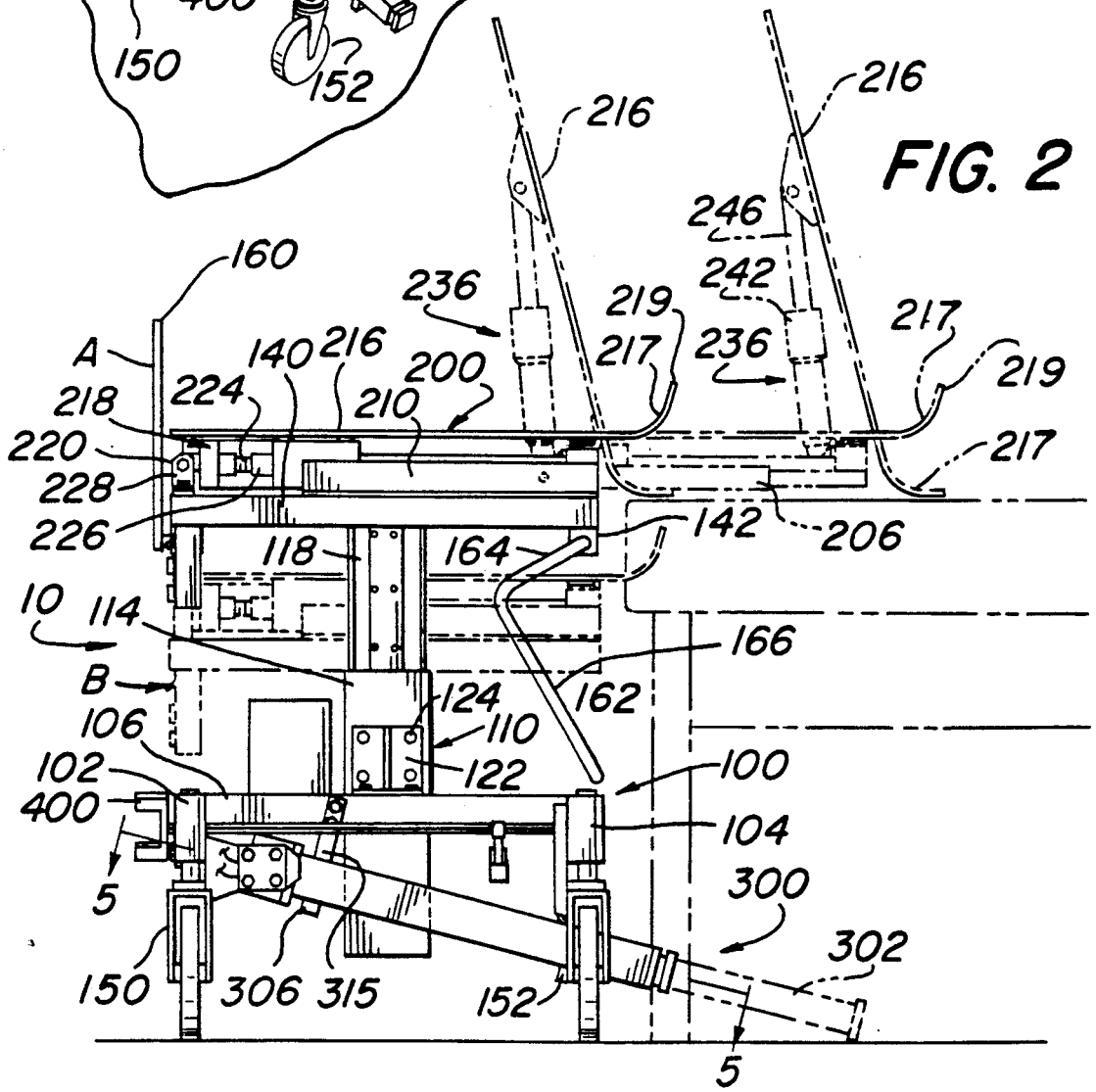
FIG. 2 is an end view of the transfer device of the present invention showing the device in various different positions.

As shown in FIGS. 1-4, the support frame 100 includes a base frame shown generally as 101 comprising two longitudinal members 102, 104 connected by two transverse members 106, 108. In the preferred embodiment, both the longitudinal and transverse members are hollow metal members, the longitudinal and transverse members being connected in any known manner, such as by welding or mechanical connection such bolting them to each other. Affixed to each of the transverse members 106, 108 are two identical telescoping support members, generally identified as 110, 112, respectively. Each support member 110, 112 includes a base guide housing 114, 116 into which is slidably fitted an upright member 118, 120. Each of the base guide housings 114, 116 may be joined to the respective transverse member 106, 108 by means of angle members 122 and bolts 124 as shown in FIG. 2, although other forms of connections are recognized as being acceptable substitutes.

Extending between the two base housings 114, 116 is a u-shaped channel member 126. (FIG. 4) Connected to the channel member 126 in between the two housings 114, 116 is a raising and lowering mechanism shown generally as 128 in the form of an hydraulic cylinder 130 and piston 132. The lower end 134 of the cylinder 130 is connected to the u-shaped channel member 126 by a clevis pin 136 passing through at least one sidewall of the u-shaped member and two vertical members 137, 139 forming a clevis and held in place by a cotter pin 141. The upper end 138 of the piston 132, and the upper ends of the upright members 118, 120 are connected to an upper frame identified generally as 140.

The upper frame 140 comprises a perimeter frame member 142 with two upper transverse members 144, 146 thereacross and an inverted u-shaped channel member 148 positioned between and connected to the upper transverse members 144, 146. The top ends of the upright members 118, 120 extending upward through the base guide housings 114, 116 are connected to the undersides of the upper transverse members 144, 146, respectively, and the upper end 138 of the piston 132 is connected to the inverted u-shaped channel member 148 in a manner similar to the clevis pin arrangement described with respect to connecting the lower end 134 of the cylinder 130 to the u-shaped member channel member 126.

As shown in FIG. 2, the support frame 100 is capable of vertical movement between raised A and lowered B (phantom line) positions. The vertical movement is achieved by actuating the hydraulic cylinder and piston mechanism 128. The piston forces upward against the inverted u-shaped member 148 and causes the upright members 118, 120 to rise in the base guide housings 114, 116, thereby raising the upper frame 140 connected to the piston and the upright members as previously described. The upper frame is lowered by reversing the motion of the cylinder/piston mechanism. By providing the telescoping support members, the upper frame 140 is stabilized against side-to-side stresses and motion. While the raising and lowering of the support frame is described in terms of the hydraulic mechanism 128, it is recognized that an electrically driven mechanism can be substituted without interfering with the functioning of the device.

Figure 4:
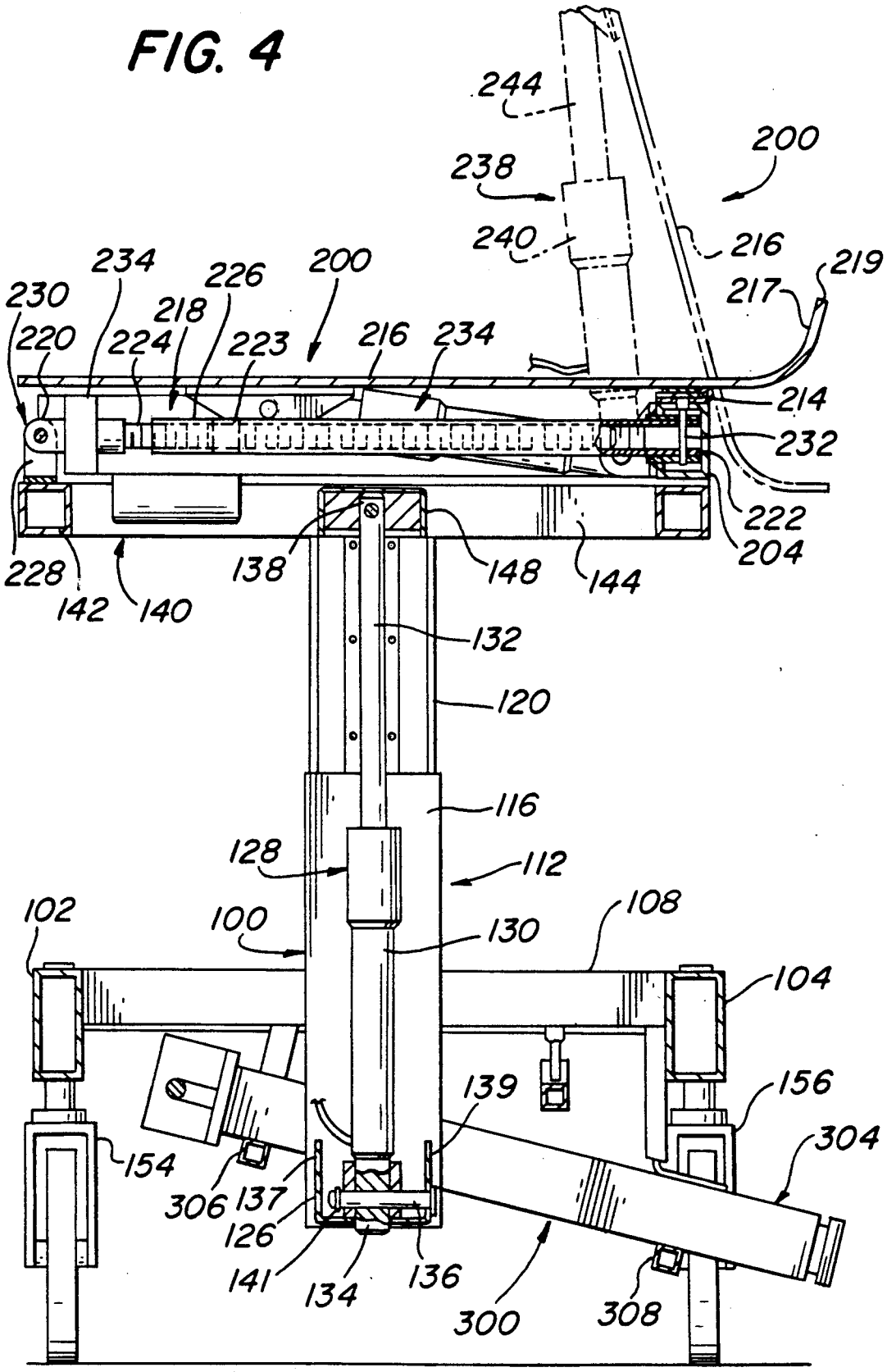
FIG. 4 is a cross-sectional view of the transfer device of the present invention taken along the line 4—4 in FIG. 3.

The litter mechanism identified generally as 200 is mounted for lateral and pivotal motion on the upper frame 140. As shown in FIGS. 2 and 4, the litter mechanism 200 includes a u-frame with one longitudinal member 204 and two lateral members 206, 208. The two lateral members 206, 208 are telescoping chassis slides mounted onto two transverse angle members 210, 212 affixed to the upper frame 140. Along the top edge of the longitudinal member 204 is a piano hinge 214 which pivotally connects a litter member 216 to the longitudinal member 204.

The horizontal or lateral movement of the slide members 206, 208 and the litter member 216 attached thereto is provided by a drive mechanism, generally shown as 218, mounted on the perimeter member 142 of the upper frame 140 at one end 220 and to the longitudinal member 204 at the other end 222 thereof. The drive mechanism 218 is preferably a linear actuator having a rotatable screw 224 screwed into a threaded nut 223 mounted within a hollow shaft 226. The actuator 218 is mounted to the upper frame 140 at location 220 by means of a clevis and a bolt and nut arrangement identified generally as 230. The hollow shaft 226 is mounted at end 222 onto the longitudinal member 204. In one embodiment, the end 222 of the threaded shaft fits into the hollow longitudinal member 204 and is held within the longitudinal member by a threaded pin 232.

The linear actuator 218 also includes a electric motor and gear box 234 connected to the rotatable screw rod 224 which imparts selective clockwise and counterclockwise rotation to the screw rod 224.

As shown in the phantom lines in FIG. 2, the actuator, when engaged, causes the longitudinal member 204 with the litter member 216 attached thereto to move laterally in a direction transverse to the position of the support frame 100, which causes the slides 206, 208 to telescope.

A further important feature of the litter mechanism 200 is the ability of the litter member 216 to pivot about the hinge 214. As shown in FIGS. 2, 3, 4 and 6, pivoting of the litter member 216 is caused by a pair of hydraulic drive mechanisms identified generally as 236, 238 connected to the litter member 216 and to the longitudinal member 204. The two hydraulic drive mechanisms include hydraulic cylinders 240, 242 with pistons 244, 246, respectively. The ends of the hydraulic cylinders 240, 244 are spaced from each other and pivotally mounted onto the longitudinal member 204, for example in a clevis and pin or bolt type arrangement, so that the ends of the cylinders located at the longitudinal member 204 are able to pivot with respect thereto. Likewise, the ends of the pistons 244, 246 are pivotally mounted onto the underside of the litter member 216, in a clevis and pin type arrangement, for pivotal movement with respect to the underside of the litter member. While a pair of hydraulic drive mechanisms 236, 238 is shown, fewer or more or other mechanisms may be used as necessary.

When it is desired to tilt the litter member 216 upward from the horizontal position (FIG. 6), the hydraulic cylinders 240, 244 are actuated, which causes the pistons 244, 246 to force away from the cylinders and urge against the underside of the litter member 216. As the pistons 244, 246 continually urge against the litter member, the extension of the pistons away from the cylinders causes the litter 216 to pivot about the hinge 214 as a horizontal axis toward an inclined position. To lower the litter member 216 from the inclined to the horizontal position, the pistons 244, 246 are withdrawn back into the cylinders 240, 242 thereby causing the litter member to pivot at the hinge 214 and causing the cylinders to pivot at their connections to the longitudinal member 204. The two hydraulic drive mechanisms 236, 238 may be either single-acting or double-acting hydraulic cylinders.

Figure 6:
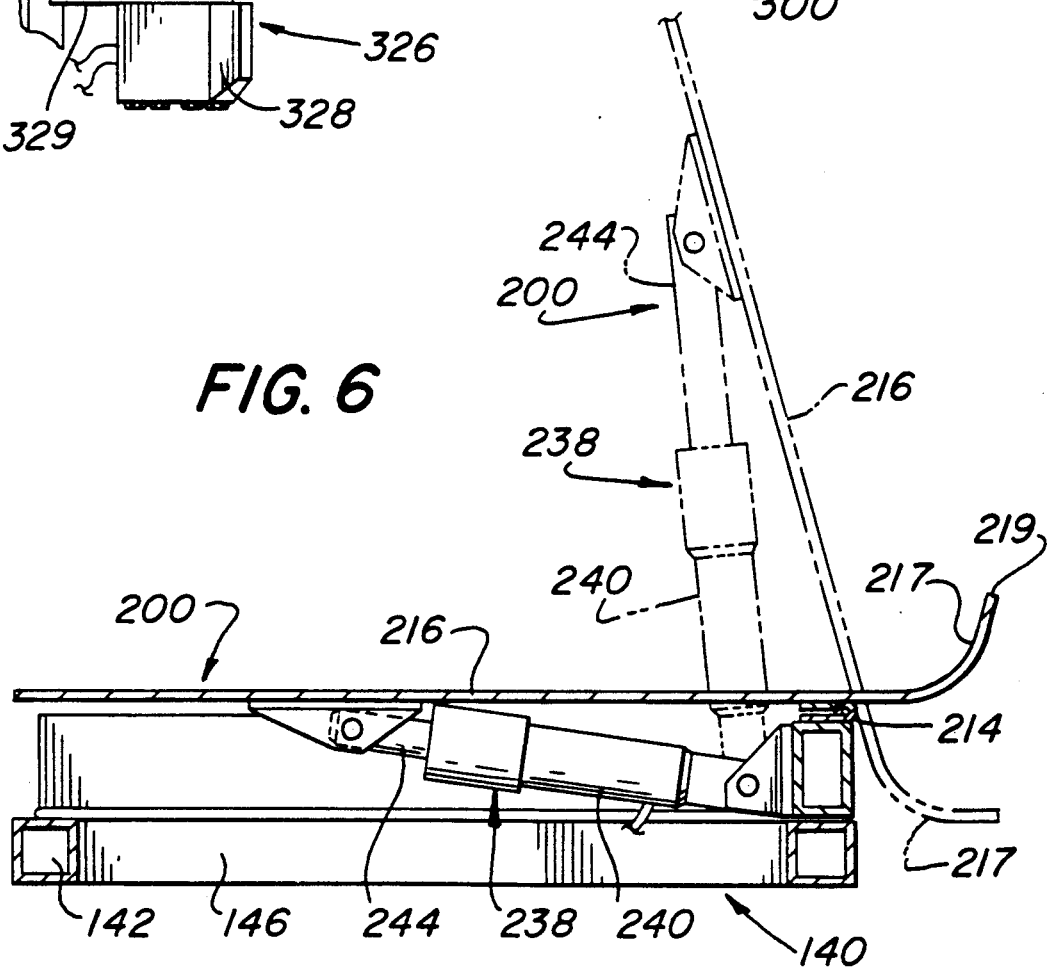
FIG. 6 is a cross-sectional view of the litter of the transfer device of the present invention shown in the raised and lowered positions.

Another important feature of the litter mechanism 200 is the lip or upwardly extended edge 217 which is provided on the litter member 216. The lip 217 extends upwardly from the planar surface of the litter member and forms the leading edge of the litter member. The leading edge is that portion of the litter member which first approaches the surface onto or from which the patient or object is or will be positioned. As shown in FIGS. 2, 4 and 6, the hinge 214 is positioned in the vicinity of the leading edge a distance from the end 219 of the lip 217. As shown in FIG. 2, when the litter member 216 is raised, the lip 217 extends outward and downward approximately in the plane of a horizontal surface. The lip 217 facilitates scooping the patient onto the litter 216, holding the patient and removing the patient therefrom.

During the times when the litter member 216 is extended horizontally and transversely of the support frame 100, the stabilizing mechanism 300 is extended in order to prevent the transfer device 10 from tipping over, especially when a patient is positioned on the extended litter member 216. As shown most clearly in FIGS. 1, 2, 4 and 5, the stabilizing mechanism 300 includes a pair of telescoping outriggers 302, 304, and each outrigger is attached to one of the transverse members 106, 108 and to the longitudinal member 104 at the bottom of the support frame 100. The outriggers 302, 304 are angled downwardly away from the transverse members 106, 108, and a pair of stretchers 306, 308 extend between the outriggers and are attached to the undersides of the outriggers to stabilize the outriggers and form the stabilizing mechanism assembly.

Each outrigger 302, 304 includes a housing 310, 312, respectively. The housings 310, 312 are connected to the base frame 101 by means such as angled extension members 311, 313 welded to the housings and mechanically fastened to the transverse members. The stretcher 306 is connected to the transverse members 106, 108 by a pair of second angled members 315, 317 welded or bolted to the transverse members and to the housings.

Inside each housing 310, 312 is an extendable leg member 314, 316. Each leg member is held within the respective housing by padding strips 319 on the rearward end of the leg member which substantially fill the space between the leg member and the inside of the housing. The strips are approximately 7 inches long and are located on each side of the leg member.

Screws 318, 320, for example, acme screws, extend into the leg members 314, 316, respectively; and engage internally threaded connectors 322, 324, such as nuts, within the leg members. By engaging the connectors 322, 324, as the screws 318, 320 rotate, the leg members 314, 316 either extend from or withdraw into the housings 310, 312 supported therein by the padding strips 319.

Figure 5:
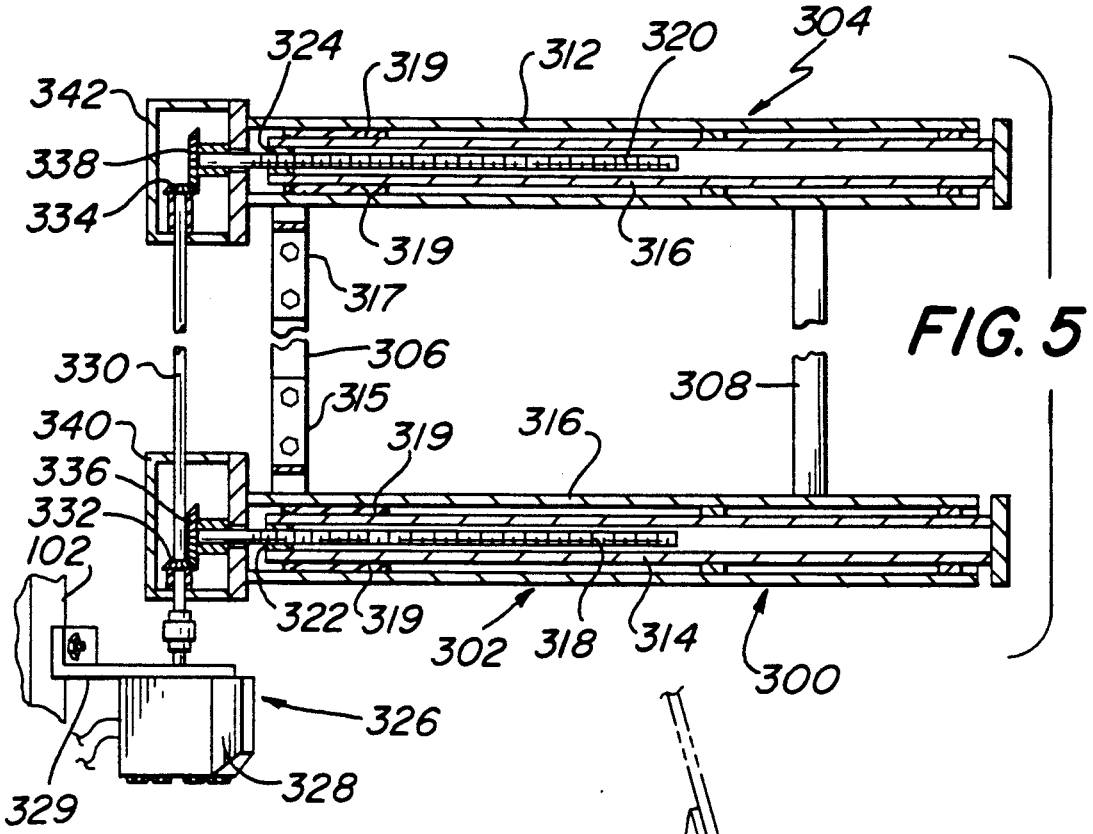
FIG. 5 is a fragmented cross-sectional view of the transfer device of the present invention taken along the line 5—5 in FIG. 2.

The screws 318, 320 are rotated by engagement with a reversible motor-driven gear drive assembly, generally shown at 326 in FIG. 5. While the drive assembly may be electrically or hydraulically operated, as shown in FIG. 5 the drive assembly 326 includes an hydraulically operated motor 328 mounted by means of an angle member 329 onto the longitudinal member 102 of the support frame 100. A transmission rod 330 is connected to the motor 328 and is rotated by operation of the motor. Two bevel gears 332, 334 are axially mounted on the transmission rod 330 and rotate as the transmission rod rotates. The two bevel gears 332, 334 engage additional bevel gears 336, 338 axially mounted on the screws 318, 320 within the housings 310, 312. The various bevel gears engage each other inside gears boxes 340, 342 mounted onto the ends of the housings 310, 312. By engaging the motor 328, the transmission rod 330 rotates along with the bevel gears 332, 324, which causes the second bevel gears 336, 338 connected to the rotator arms 318, 320 to rotate the rotator arms, thereby causing the leg members 314, 316 to extend into or out of the housings 310, 312 depending on the direction of rotation of the transmission rod 330.

While the specific embodiment of the stabilizing mechanism 300 presented in the drawings is the telescoping outrigggers, it is understood that other structures are possible for preventing the transfer device 10 from toppling over when the litter member is moved. For example, the support frame 100 might be connected to the stationary support, (e.g., a bed) holding the patient. The connection might include providing a hooking arrangement to hook the support frame 100 to the bed or perhaps even a means of chaining or tethering the support frame to the bed.

The support frame 100 also includes four casters 150, 152, 154 and 156 mounted pivotally near or at the ends of the longitudinal members 102, 104 of the base frame 101. The individual casters may have associated therewith conventional braking or locking mechanisms in order to prevent movement of the casters when the transfer device is in the desired location and position or there may be provided a central braking system connected to all of the casters which, upon engagement of a single lever 158, locks all of the casters simultaneously. In this second instance, with the central system, the braking mechanism interconnects all of the casters 150, 152, 154, 156 and can further control swivel motion of the casters. Such a system is commercially available from a West German company by the name of HACO.

In order to prevent a patient being transported on the litter member 216 from accidentally falling off the surface thereof, protective guard rails 160, 162 may be connected to the perimeter member 142 of the upper frame 140 on each longitudinal side of the litter member. Both guard rails are capable of being lowered below the horizontal surface of the litter member in order to facilitate removing or transferring a patient onto the litter member. Many types of arrangements are known for raising and lowering guard rails on gurneys, and those are acceptable for use in this invention; however, in the embodiment as shown, the construction of the guard rail, shown generally as 162 in FIG. 2, is utilized in order to make sure the guard rail extends outward around the extended edge 217 of the litter member 216, and retracts under frame member 142 in lowered position.

As shown in FIG. 2, the guard rail 162 is an angled member having horizontal 164 and vertical 166 portions pivotally mounted underneath the perimeter member 142. Because the guard rail is angled and because the horizontal portion 164 of the guard rail is of sufficient length, when the guard rail is in the upright position the vertical portion 166 of the guard rail extends upwardly along the outer extended edge 217 of the litter member 216. By pivotally mounting the angled guard rail under the perimeter member, it is possible for the guard rail to swing downward underneath the surface of the litter member in order to allow the transfer device to get as close as possible alongside the surface to which or from which the patient is being transferred. It would not be possible to get the transfer device as close to the transfer surface if the guard rail 162 were only capable of vertical movement to raise or lower it along the extended edge 217 in a manner similar to the positioning of the opposite guard rail 160.

Figure 7:
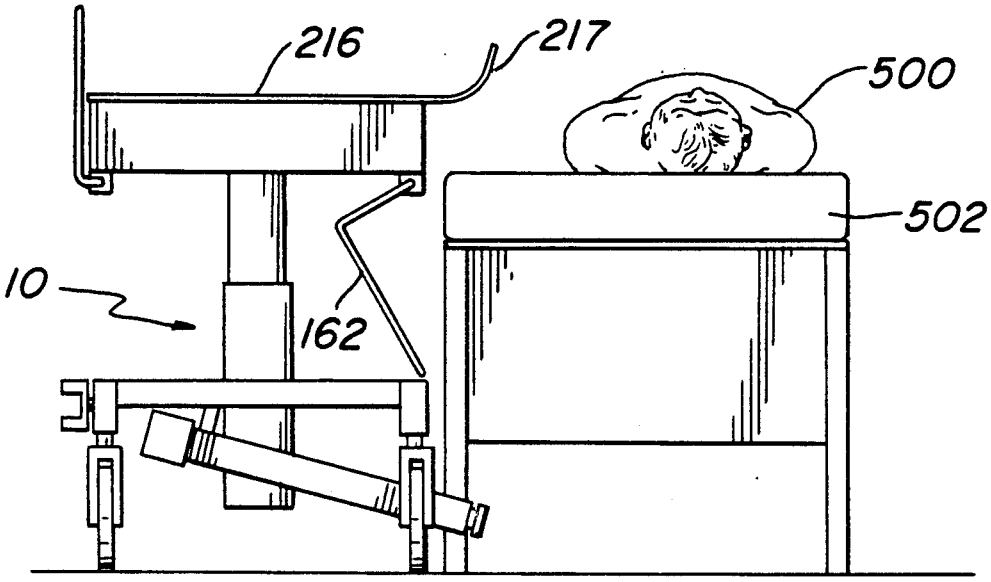
FIG. 7 is a view of the transfer device of the present invention adjacent a non-ambulatory patient on a first surface from which the patient is to be transferred.

To explain how the transfer device 10 of the present invention is used to transfer a patient from a stationary structure, such as a bed, reference is made to FIGS. 7–10. As shown in FIG. 7, a non-ambulatory patient 500 is located on a bed or stationary table 502. After the guard rail 162 has been rotated downward underneath the upper frame 140, the transfer device 10 of the present invention is rolled into position next to the bed 502 with the edge 217 of the litter member 216 extending over the bed 502, thus allowing the transfer device to get as close a possible to the bed 502. The height of the litter mechanism 200 is adjusted by means of the raising and lowering mechanism 128 in order to bring the litter mechanism above the level of the bed 502. The height of the litter mechanism is adjustable between approximately 25 to 35 inches above the floor.

Figure 8:
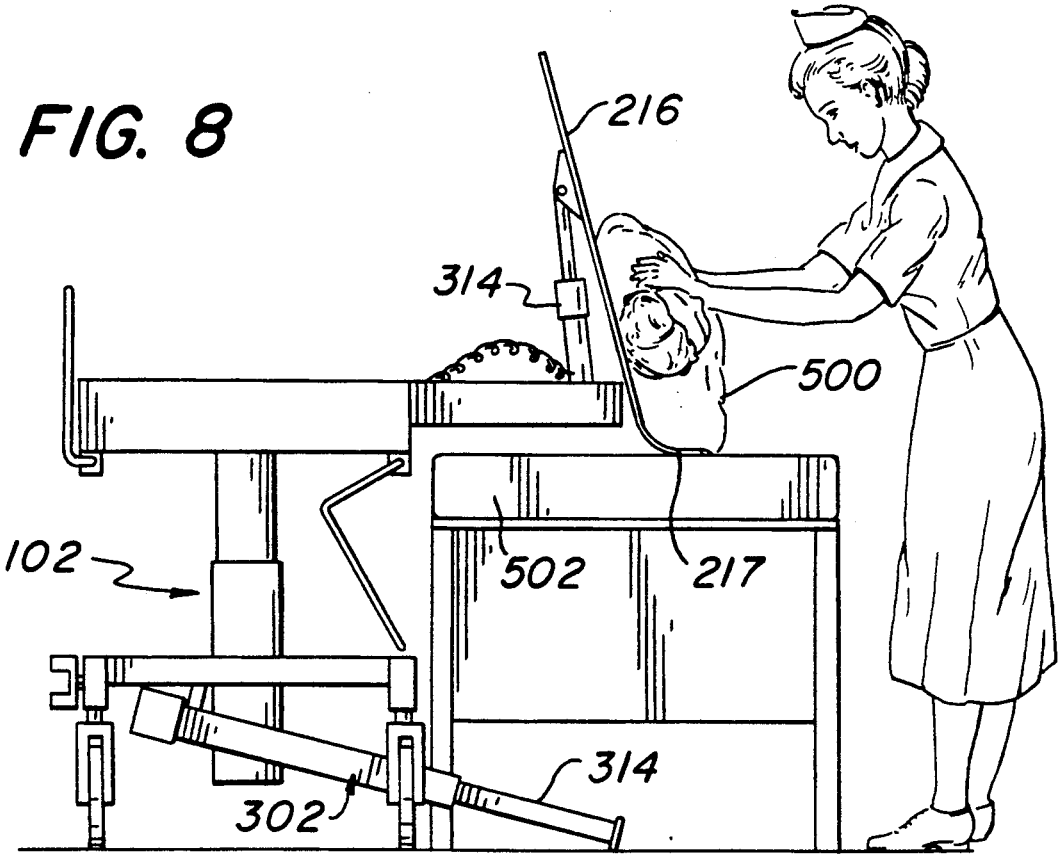
FIG. 8 is a view of the transfer device of the present invention in a first position receiving a patient being transferred for a first surface.

As shown in FIG. 8, the leg members 314, 316 of the outriggers 302, 304 are extended outward away from the housings 310, 312 in order to provide a wider base of support for the transfer mechanism so that the device is stabilized and prevented from tipping over. After the legs 314, 316 have been extended, the hydraulic pistons 236, 238 are actuated to pivot the litter member about the hinge 214 into its up or raised position. Next, the patient 500 rolls or is rolled over onto his side and the litter member 216 is moved laterally and transversely away from the support frame 100 over the bed 502 by engaging the linear actuator 218 connected to the longitudinal member 204. Preferably, the litter mechanism is capable of moving approximately 18 inches laterally away from the upper frame 140. The litter member 216 continues the lateral movement until the lip 217 slides between the patient's side and the bed and the litter member 216 engages the patient's back. The lip 217 passes underneath the patient to help scoop up the patient from the bed onto the litter member.

Figure 9:
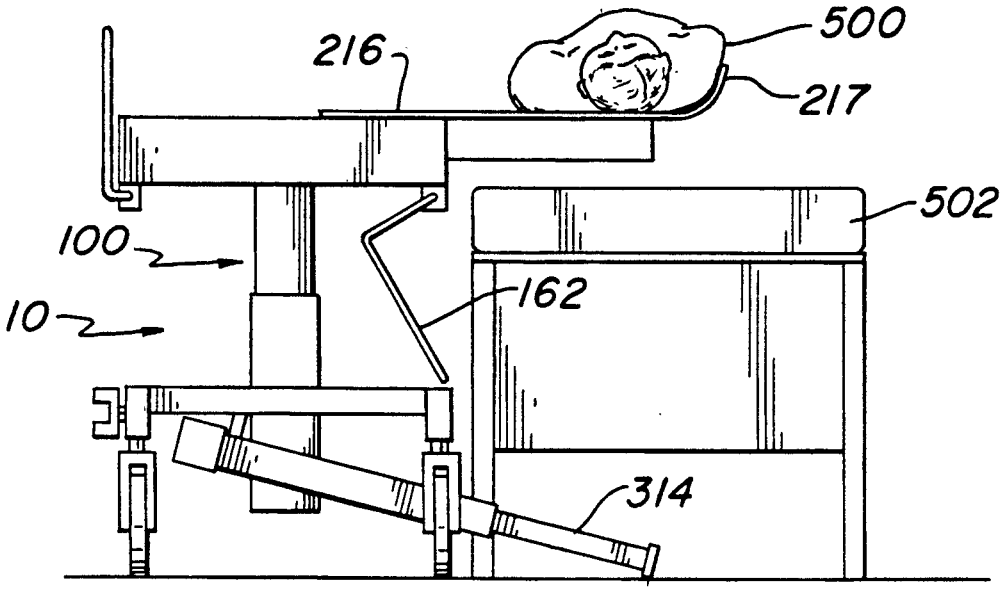
FIG. 9 is a view of the transfer device of the present invention in a second position with the patient being transferred thereon with the litter extended over the surface from which the patient is being transferred.
Figure 10:
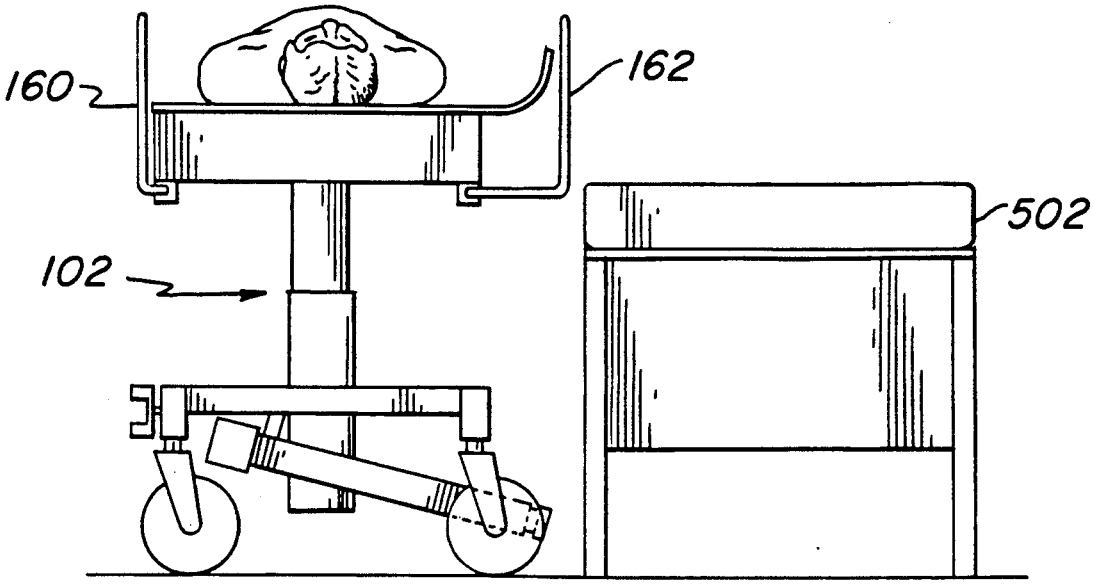
FIG. 10 is a view of the transfer device of the present invention with the patient mounted on the litter and with the litter positioned on the frame of the device and in position for transporting the patient thereon.

With the patient being guided against the litter member 216 by the attendant 504 as shown in FIG. 8, the litter member is pivoted downward to return to its horizontal position, thereby lifting the patient off the bed surface as seen in FIG. 9. The pivoting of the litter member about the hinge 214 to the horizontal position is accomplished by retracting the pistons 244, 246 into the cylinders 240, 242 of the hydraulic pistons 236, 238, respectively. After the litter member with the patient thereon is returned to the horizontal position, the litter member is withdrawn back to its starting position atop the support frame 100 by reversing the direction of rotation of the linear actuator 218.

Once the litter member 216 is back atop the support frame 100, the outstretched leg members 314, 316 of the outriggers are retracted to their position inside the housings 310, 312 by reversing the direction of rotation of the screws 318, 320. All that now remains to be done before the patient is transported to the desired location is to raise the guard rail 162 and lock it into position and to release the braking mechanism for the casters so the casters are free to rotate and swivel. The device is then ready (FIG. 10) to be pushed to another location where the patient can be unloaded.

Unloading of the patient at the new location is much the same as loading the patient onto the transfer device 10. The guard rail 162 is lowered and the transfer device is moved into position adjacent the bed. The casters are locked into position and the leg members of the outriggers 302, 304 are extended to stabilize the device. Thereafter, the litter member 216 is extended laterally and then pivoted about the hinge 214 so that the patient can be removed from the litter member. During the process of removing the patient from the upwardly tilted litter member 216, the patient's back is held away from the litter member 216 while the litter mechanism 200 is retracted onto the support frame 100. The litter member 216 is not pivoted downward to its horizontal position until after it is atop the support frame in order to make sure it is clear of the patient before being pivoted. The patient is thus left resting on his side on the bed, a position from which he can roll or be rolled onto his back. Before the transfer device 10 is moved, the legs of the outriggers are returned to their position within the housings 310, 312.

Though not shown in all of the depicted embodiments, the litter member 216 can be provided with a mattress for the patient to rest on, and in addition the litter member also can be provided with mechanical means for raising the patient's back and head or legs should this be necessary during transport.

Figure 3:
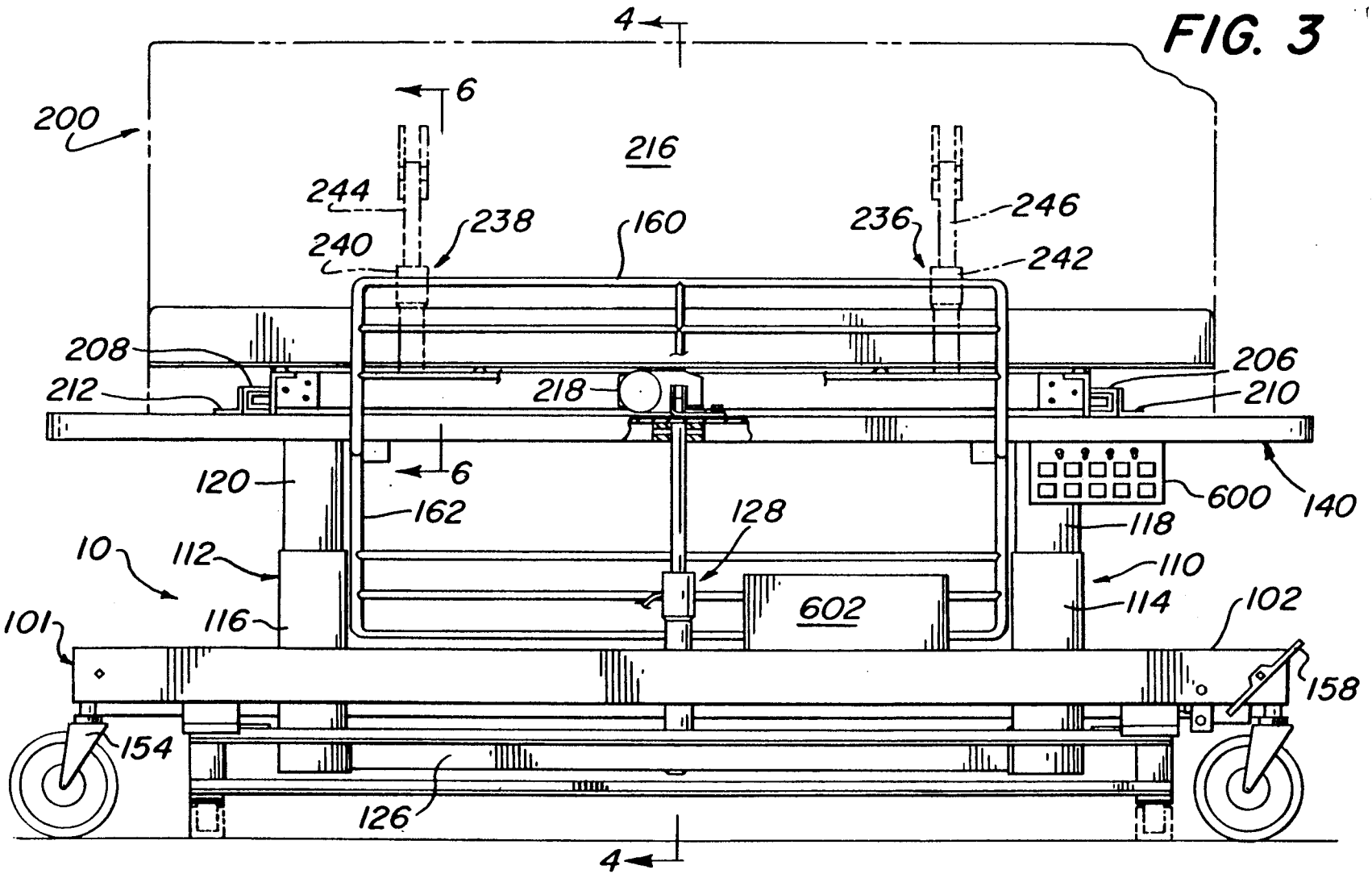
FIG. 3 is a side view of the transfer device of the present invention with the litter in the raised position.

In the preferred embodiment, the movements of the litter mechanism, litter member, the outrigger legs and the support frame are controlled by means of electrically actuated switches located at a switching panel 600. The electrical switch panel 600 is shown in FIG. 3 as being connected to the upper frame 140, however, with slight modification, the controls might be mounted on a cable for operation at a location distant from the support frame, for example the side of the bed where the attendant is maneuvering the patient into position to receive the litter member. The electrical controls are types which are commercially available and control actuation of the hydraulic cylinders, the hydraulic drive motor 328 and the electrical actuator 218 for lateral movement of the litter. As shown in FIG. 3, the main hydraulic pump 602 for actuating the hydraulic system may be mounted onto the longitudinal member 102 of the base frame 101. The connection and operation of such an hydraulic system is known to those skilled in the art and is not discussed in detail herein.

A safety feature is included in the switching control mechanism which prevents the litter from being moved laterally before the outrigger legs are extended; and furthermore, the switch control prevents the outrigger legs from being retracted into the housings before the litter member is returned to its position atop the support frame. The power assist devices lock the various moveable components into place when they are not being operated.

Figure 11:
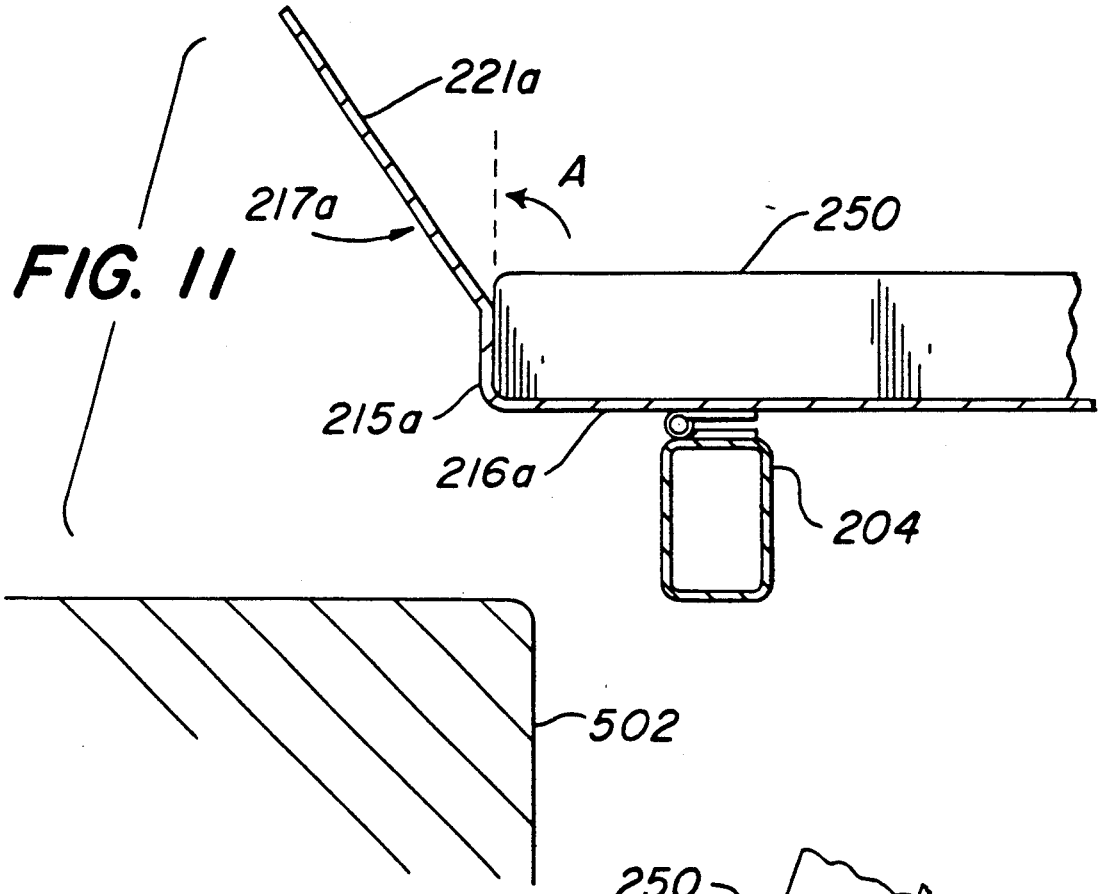
FIG. 11 is a partial cross-sectional view of a litter member lip configured to hold a litter mattress thereon, the litter member being in a horizontal position.
Figure 12:
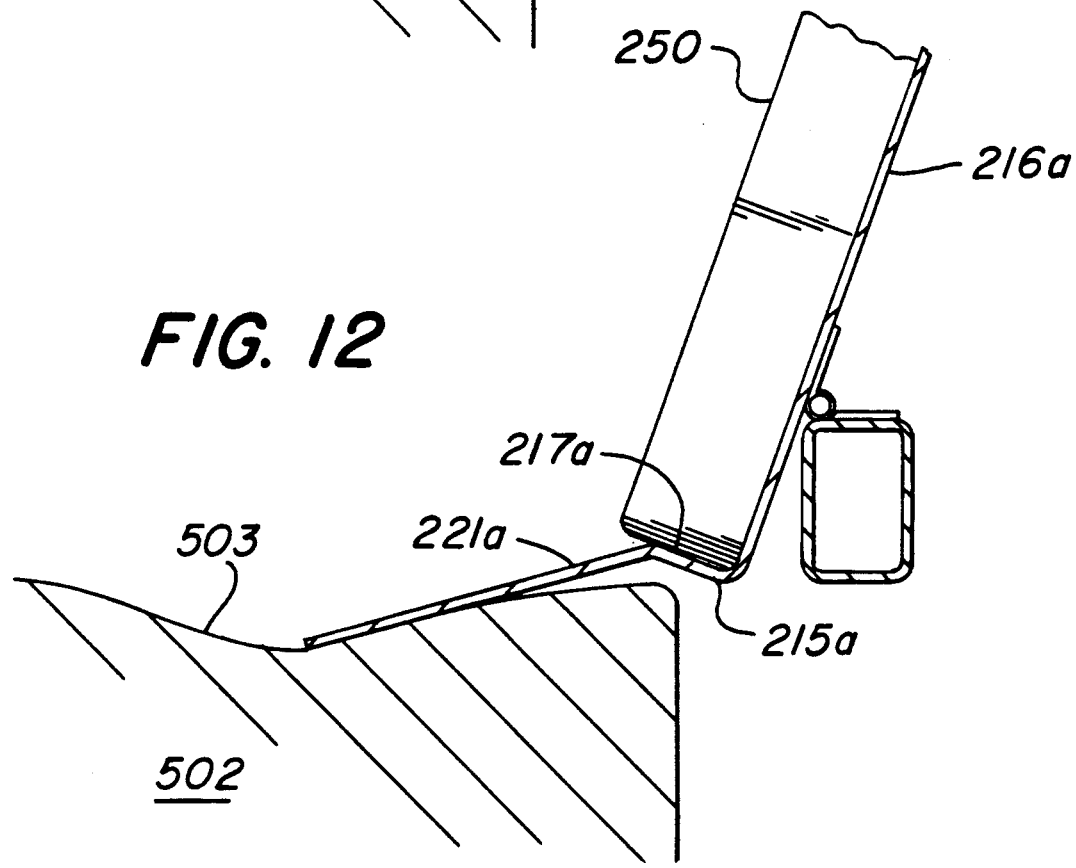
FIG. 12 is a partial cross-sectional view of the litter member lip shown in FIG. 11, the litter member being rotated about a hinge toward an adjacent mattress.

An alternate embodiment of the litter member **216*a* is shown in FIGS. 11 and 12. In this embodiment, the lip 217*a* is formed with a 90° angled portion 215*a* and an inclined lip portion 221*a* which extends from the 90° angled portion 215*a* at approximately a 35° angle A. By providing the 90° angle portion 215*a*, a mattress 250 on the litter member 216*a* can be held in place and not interfere with loading and unloading the litter member 216*a* by means of the 35° angled portion 221*a***.

The inclined lip portion **221*a* functions much like the lip 217 (FIG. 2) to scoop up the patient; however, unlike the scoop of the first embodiment which is designed to be roughly parallel to the surface of the bed 502 when the litter member is rotated, this second lip 221*a*, by extending at a 35° angle from the 90° angled portion 219*a*, can depress the mattress 502 on which the patient is lying to form a well 503 in the mattress. This well 503 in the mattress enables the patient rolled on his or her side to be more easily positioned onto the lip 217*a* for transfer to the mattress 250** on the litter member.

As shown in FIGS. 1 and 7–10, the transfer device 10 of the invention is designed to be rolled into position along side the bed or other surface supporting the patient to be moved, so that the litter can be moved laterally to a position where the lip 217 of the litter is adjacent and under the patient. Lateral movement of the litter is necessary because the support frame of the gurney must remain at the side of the bed. If, however, the base frame 101 is constructed in such a manner that it can slide between the legs of, and under, the bed frame, the litter lip 217, without lateral movement with respect to the base frame, can be positioned adjacent and under the patient by rolling the base frame under the bed frame. In this construction, the litter would still pivot about its leading edge to receive or deposit the patient onto the bed.

Without further elaboration, the foregoing will so fully illustrate our invention that others may, by applying current or future knowledge, adopt the same for use under various conditions of service.

We claim:

1. A transfer device for moving an object from a first location to a second location, said device comprising:

litter means for carrying said object to be transported thereon;

support means including fixed guide means for supporting said litter means, laterally movable means associated with said fixed guide means and means for moving said litter means laterally with respect to said support means and guide means members, back and forth from said first location to said second location;

said litter means having a leading edge adapted to be positioned adjacent said object to be moved means associated with said laterally movable means to cause said litter means to pivot from a generally horizontal position toward said object after said litter means have moved laterally to said second location and to pivot back to a generally horizontal position after said object has been positioned on said litter means; and stabilizing means connected to said support means for preventing said transfer device from tipping over when said litter means is moved laterally with respect to said support means.

2. A transfer device as claimed in claim 1, wherein:

said litter means is comprised of:

a litter member having a substantially planar carrying surface and an upwardly extending edge along one said of said planar surface, and litter frame means mounted on said support means for holding said litter member.

3. A transfer device as claimed in claim 2, including litter frame means mounted on said support means for holding said litter member and wherein said litter frame means being laterally moveable with respect to said support means.

4. A transfer device as claimed in claim 3, wherein said litter means is further comprised of first driving means connected between said litter frame means and said support means for moving said litter frame means transversely with respect to said support means.

5. A transfer device as claimed in claim 4, wherein said first driving means comprises a linear actuator having first and second ends, said linear actuator at said first end thereof being connected to said litter frame means and at said second end thereof connected to said support means.

6. A transfer device as claimed in claim 3, wherein:

said litter means is further comprised of transverse driving means connected between said litter frame means and said support means for moving said litter frame means laterally and transversely with respect to said support means; and further comprising stabilizing means mounted on said support means for preventing said transfer device from tipping over when said litter means is moved transversely with respect to said support means.

7. A transfer device as claimed in claim 6, further comprising control means interconnecting said stabilizing means and said transverse drive means for preventing lateral movement of said litter means unless said stabilizing means is in position to prevent said transfer device from tipping over.

8. A transfer device as claimed in claim 2, wherein said litter means is further comprised of pivot means connected to said litter frame means and said litter member for pivoting said litter member about said hinge means.

9. A transfer device as claimed in claim 8, wherein said pivot means is comprised of at least one hydraulic drive mechanism connected at a first end thereof to said litter means and at a second end thereof to said litter frame means.

10. A transfer device as claimed in claim 2, further comprising stabilizing means connected to said support means for preventing said transfer device from tipping over when said litter means is moved transversely with respect to said support means.

11. A transfer device as claimed in claim 10, wherein said stabilizing means is comprised of;

outrigger means mounted on said support means for engaging the surface on which said support means is resting and preventing said support means and litter means from tipping over, said outrigger means being extendable away from said support means.

12. A transfer device as claimed in claim 11, further comprising a second driving means connected to said outrigger means for extending said outrigger means away from said support means.

13. A transfer device as claimed in claim 12, wherein said outrigger means comprises:

at least one housing; and a leg member slideably mounted within said housing and moveable outward from said housing, said leg member being engageable with said drive means and moveable thereby.

14. A transfer device as claimed in claim 13, wherein said second driving means comprises:

a rotatable screw engaging said leg member; and first rotating means engaging said screw for rotating said screw, whereby rotating said screw causes said leg member to move within said housing.

15. A transfer device as claimed in claim 14, wherein said first rotating means comprises:

a first gear axially mounted onto said screw, a transmission rod, a second gear axially mounted on said transmission rod, said second gear intermeshing with said first gear; and second rotating means connected to said transmission rod for rotating said transmission rod, whereby rotating said transmission rod causes said intermeshed first and second gears to rotate, thereby rotating said screw.

16. A transfer device as claimed in claim 15, wherein said second rotating means is an hydraulic motor.

17. A transfer device as claimed in claim 2, wherein said upwardly extending edge along said planar surface of said litter member is comprised of a first lip formed at an angle with said planar surface.

18. A transfer device as claimed in claim 17, wherein said upwardly extending edge further comprises a second lip inclined at an angle from said first lip.

19. A transfer device as claimed in claim 18, wherein said first lip is formed at a 90° with said planar surface and said second lip is inclined at approximately a 35° angle from said first lip.

20. A transfer device as claimed in claim 2, wherein said litter means is further comprised of driving means connected between said litter frame means and said support means for moving said litter frame means transversely with respect to said support means.

21. A transfer device as claimed in claim 20, wherein said upwardly extending edge along said planar surface of said litter member is comprised of a first lip formed at an angle with said planar surface.

22. A transfer device as claimed in claim 21, wherein said upwardly extending edge further comprises of a second lip inclined at an angle from said first lip.

23. A transfer device as claimed in claim 22, wherein said first lip is formed at a 90° with said planar surface and said second lip is inclined at approximately a 35° angle from said first lip.

24. A transfer device as claimed in claim 1 wherein said support means is comprised of:

a base frame;

an upper frame;

a plurality of casters mounted onto said base frame; and raising and lowering means between said upper and base frames for moving said upper frame relative to the position of said base frame.

* * * * *